United States Patent [19]

Müllner

[11] Patent Number: 4,909,903

[45] Date of Patent: Mar. 20, 1990

[54] WET PRESS NIP WITH NONROTATING ADJUSTABLE BELT EXIT GUIDES

[75] Inventor: Josef Müllner, Heidenheim, Fed. Rep. of Germany

[73] Assignee: J. M. Voith GmbH, Fed. Rep. of Germany

[21] Appl. No.: 164,540

[22] Filed: Mar. 7, 1988

[30] Foreign Application Priority Data

Mar. 13, 1987 [DE] Fed. Rep. of Germany ..... 3708191

[51] Int. Cl.[4] ..... D21F 3/02

[52] U.S. Cl. ..... 162/205; 162/273; 162/358

[58] Field of Search ..... 162/205, 272, 273, 358, 162/360.1

[56] References Cited

U.S. PATENT DOCUMENTS

| | | | |
|---|---|---|---|
| 3,547,776 | 12/1970 | Curtis | 162/358 |
| 3,607,626 | 9/1971 | Nilsson . | |
| 4,272,317 | 6/1981 | Roerig | 162/272 |
| 4,483,745 | 11/1984 | Wicks et al. | 162/360.1 |
| 4,503,765 | 3/1985 | Schiel . | |
| 4,662,992 | 5/1987 | Mirsberger | 162/358 |
| 4,673,461 | 6/1987 | Roerig et al. | 162/205 |

FOREIGN PATENT DOCUMENTS

| | | | |
|---|---|---|---|
| 3324408 | 2/1984 | Fed. Rep. of Germany . | |
| 240042 | 10/1986 | Fed. Rep. of Germany | 162/205 |
| 79919 | 2/1971 | German Democratic Rep. . | |
| 2071293 | 9/1981 | United Kingdom | 162/358 |

OTHER PUBLICATIONS

Evans, "More Than 100 Machines are to be Equipped with Super Wet Presses" Pulp and Paper, Jan. 1989, pp. 129–131.

*Primary Examiner*—Karen M. Hastings

*Attorney, Agent, or Firm*—Ostrolenk, Faber, Gerb & Soffen

[57] ABSTRACT

A paper machine includes a double-felt (or single-felt) wet press. Two press elements, for instance two rolls, whose axes lie in a press plane, form a press nip with each other. Two endless felt belts, and between them the paper web from which the water is to be removed, pass through said nip. Beyond the press nip the paper web travels, free of the felt belts, to the next station of the paper machine. Each of the two felt belts travels beyond the press nip over a guide element, which can be a guide roll or a nonrotating deflector, whose position is displaceable parallel to the press plane. The arrangement is operated as follows: The angle between the paper web and the wetter felt is set to a smaller value during the initial licking-up process than during the subsequent continuous operation. On the other hand, the angle between the paper web and the drier felt is set to a larger value during the initial licking-up process than during the subsequent continuous operation.

38 Claims, 2 Drawing Sheets

WET PRESS NIP WITH NONROTATING ADJUSTABLE BELT EXIT GUIDES

BACKGROUND OF THE INVENTION

The present invention relates to a wet press for a machine for the manufacture of paper, board or similar webs of fibrous material, of the type which comprises a press shell which passes continuously over a press shoe supported on a support member, and a mating roll which opposes the press shoe and forms a press nip with the press roll. More particularly, it is related to means for preventing, or at least reducing, the remoistening of the web of fibrous material upon its emergence from the nip of the wet press.

This problem can occur in wet pressed which have only a single water-absorbing endless belt (so-called single felt presses), but is particularly serious in those presses in which the web of fibrous material passes through the press nip between two belts, in which one of the two endless belts, hereinafter called at times the "first belt", always has a higher water-absorbing capacity than the other endless belt, hereinafter called at times the "second belt". Both belts can be felt belts; in such case the press is a so-called double-felt press.

The following publications disclose known presses which are in the background of the present invention:

1. U.S. Pat. No. 3,607,626, issued Sept. 21, 1971.
2. Federal Republic of Germany OS No. 33 24 408, published Feb. 2, 1984.
3. U.S. Pat. No. 4,503,765, issued Mar. 12, 1985, commonly assigned herewith, whose disclosures are incorporated by reference herein.
4. German Democratic Republic Pat. No. 79,719 issued Feb. 12, 1971.

In the single-felt press of GDR Pat. No. 79,719, the web of fibrous material from which the water is to be removed passes through the press nip between a water-absorbing felt belt and a non-water-absorbing liquid-impervious press belt.

Federal Republic of Germany OS No. 3,324,408 suggests that in order to reduce the remoistening of the web of fibrous material it should be endeavored to separate the paper web from the two felt belts directly behind the press nip. Actual practice, however, shows that this desire is frequently not realizable, since in actual practice the web of fibrous material from which the water is to be removed always travels together with one of the two felt belts at least over a short joint path of travel beyond the press nip. To be sure, one can attempt to shorten the joint path by increasing the tensile stress in the discharging web of fibrous material. However, close limits exist a to what can be achieved, since the web of fibrous material which is still moist undergoes an undesired elongation under tensile stress, as a result of which, as a general rule, the quality of the final web of fibrous material is reduced.

The present invention is also concerned with the problems which relate to the so-called process of "licking-up" the web of fibrous material, i.e. with the threading of the web of fibrous material into the paper machine (upon the starting of the paper machine or after breakage of the web). During the lick-up, as it is also known, initially only a narrow strip at the edge of the web of fibrous material travels through the wet press, and from there to the next section of the paper machine. The web of fibrous material is then slowly brought to its full width with the tensile stress in the web being as a rule set at a particularly low value. This has the result that the web of fibrous material upon its emergence from the press nip of the wet press initially travels over a relatively long joint path of travel with the felt belt or one of the two felt belts. By a careful increase in the tensile stress, one then attempts to shorten the joint path of travel, so as to keep the remoistening of the web of fibrous material by the felt belt as slight as possible.

Another problem resides in the fact that the end of the joint path of travel, where the web of fibrous material detaches itself from the felt belt, is not precisely defined. In other words, the web of fibrous material sometime detaches itself earlier and sometimes after from the felt belt in question. This detachment furthermore does not always occur at the same place over the width of the paper machine. In a double-felt press it can also happen that a part of the web of fibrous material tends to travel with one of the felt belts and another part of the web of fibrous material with the other felt belt. As a result of all of these factors, the quality of the web of fibrous material may be impaired, and there may be a danger of the web of fibrous material being torn.

In U.S. Pat. No. 3,607,626, measures are described for reducing the remoistening of the web of fibrous material. From that patent it is known that the web of fibrous material from which the water is to be removed normally follows the wetter felt belt behind the nip of the double felt press, that is, the felt belt which has absorbed the larger amount of water from the web of fibrous material in the nip of the press. The web of fibrous material adheres more strongly to this felt belt than to the drier felt belt. As a result of this, the tendency towards remoistening of the web of fibrous material behind the press nip is particularly great. In order to counteract this tendency, measures are described in U.S. Pat. No. 3,607,626 which are intended to have the result that, in the normal operation of the paper machine, the web of fibrous material does not travel together with the wetter felt belt behind the nip of the press, but rather with the drier felt belt. For this purpose, a suction zone is arranged behind the press nip, in the press roll which the drier felt belt is wrapped around. Means are also provided for displacing the path of travel of the wetter felt belt so that during the licking-up of the web of paper it travels over the suction zone together with the drier felt belt. The suction zone holds the web of paper firm against the drier felt belt even when the wetter felt belt assumes its normal path of travel in continuous operation. However, this known arrangement has disadvantages, namely the expense of the suction zone means, and the remoistening of the web of fibrous material by the drier felt of the web, which is still present to some degree.

SUMMARY OF THE INVENTION

The central object of the present invention is to improve this general type of wet press, to further reduce the extent of the remoistening of the web of fibrous material emerging from the press nip. In this connection, means are provided for carrying out the transition from the initial operating condition during the licking-up, to the final continuous operating condition.

According to one aspect of the invention, a wet press for dewatering a fibrous web, comprises frame means; first and second press mans, each of said press means comprising a press member which is rotatable about an axis of rotation; said press members together forming a press nip; the axis of said first press member, together with said press nip, defining a press plane; guide means for guiding a fibrous web to be dewatered and at least a water-absorbing first belt through the press nip, said guide means including first belt exit guide means for guiding said first belt following its exit from the press nip; so that said first belt defines an angle of emergence a with said press plane on the side of said first belt away from said press nip; said fibrous web defining a web travel path; said first belt exit guide means being operable for adjusting said angle of emergence a to a first value during a first phase of dewatering said fibrous web in said wet press, and to a second value during a second phase of dewatering said fibrous web in said wet press.

The guide means, which may be a guide roll, is operable for adjusting said angle of emergence a to said first value when said fibrous web is being initially inserted into said wet press, and to said second value at a subsequent time, said second value being smaller than said first value. It is selectively displaceable generally transverse to said web travel path, preferably substantially parallel to said press plane.

The first belt exit guide means may also comprise a non-rotating deflection member which is displaceable substantially parallel to said press plane. It may be attached to a spray water collection trough. There may also be web exit guide means for guiding said fibrous web following its exit from the press nip. The first belt exit guide means and web exit guide means ar preferably operable for maintaining a substantially constant angle c between said first belt and said web.

The wet press may further comprise frame means; guide means for guiding a second belt through the press nip; said second belt defining an angle of emergence b with said press plane on the side of said second belt away from said press nip; said first and second belt exit guide means being operable for adjusting said angles of emergence a and b to respective first values during a firs phase of dewatering said web, and to respective second values during a second phase of dewatering said web. The second belt may have lower water-absorbency than the first belt. The second belt may comprise felt material, or be substantially liquid-impervious.

Advantageously, said second value of angle a is smaller than said first value; and said second value of angle b is larger than said first value. The first and second belt exit guide means may be operable for adjusting said angles a and b such that their sum remains substantially constant during said two phases.

Preferably, said first and second belts respectively define angles d and e with said web, said angles d and e being substantially 2°-8°. The angle d advantageously increases from about 3° to about 6° from said first phase to said second phase. The angle e advantageously decreases from about 6° to about 3° from said first phase to said second phase.

In another aspect of the invention, the second press member comprises a press shell which rotates around a support member, and press shoe means comprising a press shoe mounted on said support member for urging said press shell against said second belt and toward said first press member. The axis of rotation of said press shell may be substantially at said press plane. Alternatively, the axis of rotation of said press shell may b offset from said press plane in a direction away from said belt exit guide means; whereby said press shell is eccentric to said press plane. Further, said press shoe may have a slide surface which contacts an inside surface of said press roll and defines a width of an area press nip, the center of said slide surface being spaced from the press plane in a direction away from said belt exit guide means. The slide surface of said press shoe may have an extension on a side of said press shoe opposite said belt exit guide means, the center of the slide surface of the press shoe being thereby offset from the press plane so that the extension is located substantially within the eccentric press shell. Said press shell is preferably substantially circular.

A further aspect of the invention relates to a method of operating a wet press for dewatering a fibrous web, said wet press comprising adjusting an angle a defined between a first water-absorbent belt and a press plane to a first value during a first phase of dewatering said web, and to a second value during a second phase of dewatering said web. The angle a may have said first value when said web is being initially inserted into said press, and said second value at a subsequent time, said second value being smaller than said first value. It may further comprise maintaining a substantially constant angle c between said first belt and said web during said two phases.

An angle b defined between a second belt and said press plane may have a first value when said web is being initially inserted into said press, and a second value at a subsequent time, said second value being larger than said first value. The angles a and b may be adjusted such that their sum remains substantially constant during said two phases.

Angles d and e defined between the web and the first and second belts, respectively, may vary from about 2° to about 8°. The first angle d may increase from about 3° to about 6° from said first phase to said second phase. The angle e may decrease from about 6° to about 3° from said first phase to said second phase.

According to one aspect of the invention, for the special case of a single-felt press, the direction of emergence of the endless water-absorbing belt, preferably a felt belt, can be shifted, by shifting the position of a felt-belt guide element which is arranged directly behind the nip of the press. Another possible way of shifting the direction of emergence of the felt belt, relative to the plane of pressing, is to shift the plane of pressing itself, by swinging one of the press elements around the axis of the other press element.

Another aspect of the invention relates to the following procedure: During the licking-up of the web of fibrous material, the emergence angle of the felt belt is adjusted to have a larger value than in the subsequent continuous operation. As a result, the wedge of air, which is located between the felt belt and the emergence side of the press element in question (for instance a press roll), extends during the licking-up further towards the press nip than during continuous operation. Thus, during the licking-up, the air can penetrate directly behind the press nip through the pores of the felt belt to the web of fibrous material, so that the web of fibrous material easily detaches itself from the wet felt belt. In other words, both the lick-up strip which is initially passed through the nip, and the full-width web of fibrous material, can be detached from the wet felt belt at a very short distance from the press nip. This can be done without having to establish an excessively high tensile stress in the emerging web of fibrous material. To be sure, during the licking-up operation, the web of fibrous material still travels together with the wet felt belt over a short path of travel. This joint path of travel can be further shortened upon the transition to continuous operation by reducing the angle of emergence of the wet felt belt, and possibly by carefully increasing the tensile stress in the web of fibrous material. In this connection it may be advantageous at the same time to shift the angle of emergence of the web of fibrous material in the same direction as the angle of emergence of the wet felt belt.

Another aspect of the invention concerns an arrangement in which the web of fibrous material passes through the press nip between two endless belts. In other words, in addition to the water-absorbing endless belt described above (hereinafter called at times the "first belt"), there is further provided a "second belt" which is also endless. This second belt can also be a porous, water-absorbing felt belt, or else it may be a water-impervious and substantially non-water-absorbing rubber or plastic-like belt (as in German Democratic Republic Pat. No. 79,919).

In accordance with a further feature of the invention, in the case of a wet press employing two endless belts one proceeds as follows: During the licking-up of the web of fibrous material, the angle of emergence of the first belt is adjusted to a larger value and the angle of emergence of the second belt to a smaller value tan during the subsequent continuous operation. In this way, the result is obtained that, during the licking-up, the web of fibrous material is detached from the wet first belt directly behind the emergence nip, and initially travels a short distance together with the second belt. This is possible, in turn, because the first belt, as a result of the large angle of emergence, affords the air an opportunity to flow through the pores directly behind the press nip (called "rear airing").

The invention accordingly is based on the discovery that, without the expensive measures disclosed in U.S. Pat. No. 3,607,626, it is possible to cause the web of fibrous material not to travel jointly with the wetter felt belt (i.e., with the felt belt having the higher water-absorbing capacity), but rather with the second endless belt. The web of fibrous material can be detached from this second belt with much less tensile force than from the wetter first belt, regardless of whether the second belt is also of felt or is a water-impervious press belt. Thus it is possible relatively easily, by careful increase in the tensile stress, considerably to shorten the joint path of travel of the web of fibrous material and the second belt. For this purpose it is necessary, upon changing over to continuous operation, to increase the angle of emergence of the second belt in order to achieve a "rear airing" of this belt also, and at the same time to reduce the emergence angle of the first belt (as in the case of the single-felt press). Under optimal conditions, one can achieve the result that the web of fibrous material is simultaneously detached from both endless belts directly behind the nip of the press. These changes in the angles of emergence are limited by the fact that the web of fibrous material must be able to travel as a free length of web and, insofar as possible, without contact with one of the endless belts, from the press nip of the wet press to the following section of the paper machine.

It may be advantageous to change the angle of emergence of the two endless belts jointly by means of a joint displacement device, so that the sum of the two emergence angles remains substantially the same. The angle of emergence of the web of fibrous material can in this connection generally remain unchanged. However, a simultaneous displacement of the angle of emergence of the web of fibrous material may also be advantageous.

BRIEF DESCRIPTION OF THE DRAWINGS

Other objects, features and advantages of the invention will be understood from the following detailed description of embodiments thereof, with reference to the drawings, in which.

DETAILED DESCRIPTION

Figure 1:
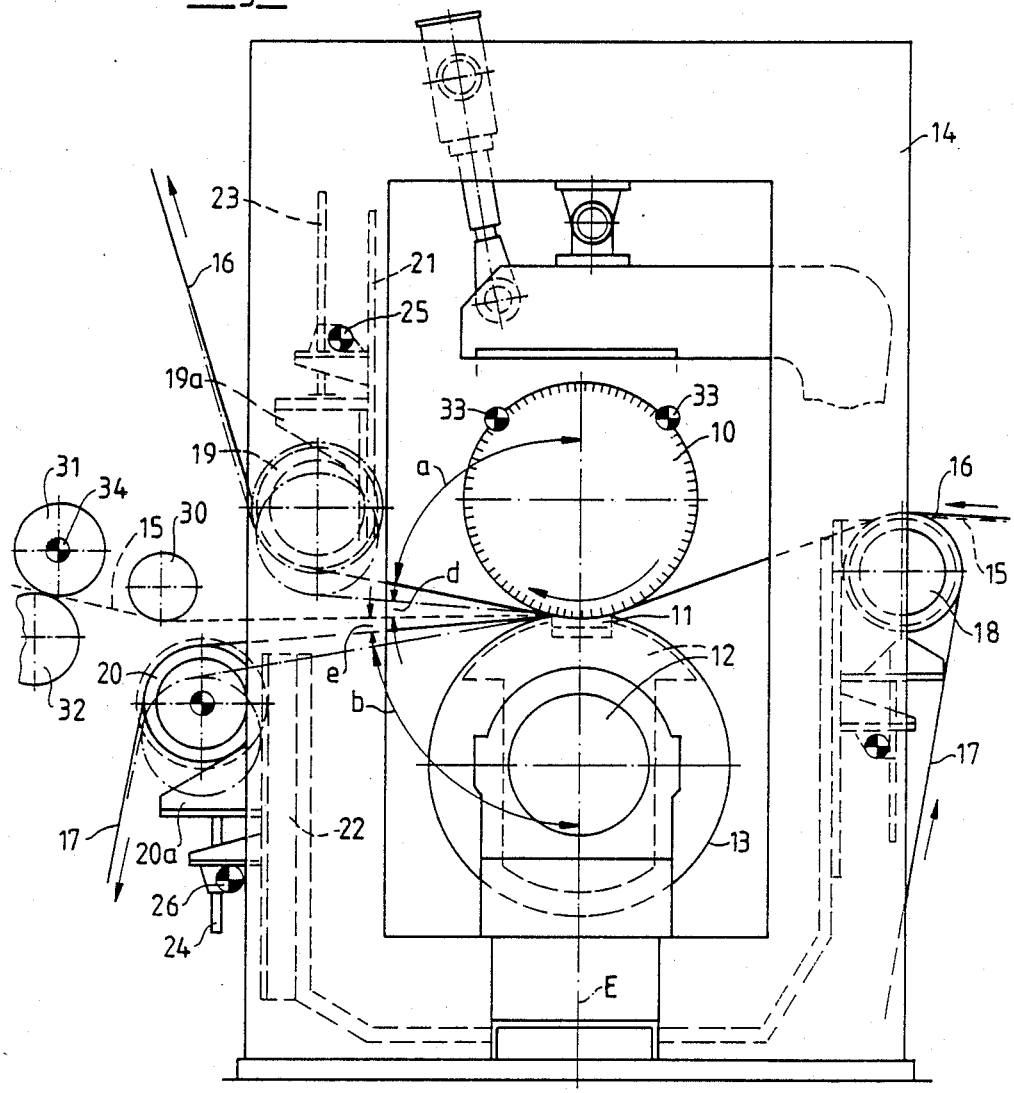
FIG. 1 shows a double-felt long-nip press, embodying the invention.

The essential parts of the wet press shown in FIG. 1 are two press elements, namely a press roll 10 and a press shoe 11. The press roll 10 has a roll shell which, as shown symbolically, is provided with blind holes, circumferential grooves or the like for the temporary storing of water. The press shoe 11 is radially movable and is supported on a stationary support member 12. A tubular elastic press shell 13 rotates around the support member 12 and around the press shoe 11. The press elements 10–13 are supported at each of their two ends by a pair of press frame 14, only one of which is shown in the drawing.

The press roll 10 and press shell 13 form with each other an areal press nip through which a paper web 15 (indicated by a dashed line) passes, together with two endless felt belts, namely an upper felt 16 and a lower felt 17. On the inlet side of the wet press, i.e., the side from which the paper web 15 comes, a common guide roll 18 for both felt belts 16 and 17 is provided. On the outlet side of the wet press, on the other hand, from which side the paper web 15 emerges, separate guide rolls 19 and 20 are provided for the two felt belts 16 ad 17 respectively.

The central plane of the wet press is the so-called press plane E, which is preferably arranged vertically. If the web press is a two-roll press as in FIG. 3, the press plane is defined by the axes of the two press rolls. On the other hand, if the web press is a shoe press as in FIGS. 1 and 4, the press plane is defined by the axis of the press roll 10 and the axis of the stationary support member 12. In the latter case, the press plane intersects the press shoe 11 and the press nip, but not necessarily the axis of the press shell 13, as will be explained further below in connection with FIG. 4.

The two emergence-side guide rolls 19 and 20 are adjustable approximately parallel to the press plane E, and therefore preferably in the vertical direction. For this purpose, the bearing brackets **19*a* and 20*a* of these two guide rolls rest in slide rails 21 and 22 which extend in the vertical direction and are fastened to the press frame 14. For displacing the bearing brackets 19*a* and 20*a* which support the guide rolls 19 and 20, respective spindles 23 and 24 and spindle drives 25 and 26 are provided. Each of the two spindles can be driven individually and thus the two guide rolls 19 and 20 can each be displaced independently in the vertical direction. However, it is also possible to actuate the two spindle drives 25 and 26 jointly. If, for instance, electric motors are provided for the driving of these spindles, then the power supplies for the two electric motors can be coupled to each other. In this way it is possible to displace, if necessary, both guide rolls 19 and 20** jointly upward or downward.

The paper web 15 leaves the press nip in the form of a substantially free length of paper (open draw) in approximately the horizontal direction. It can, for example, as shown in FIG. 1, travel first over a guide roll 30, on which it is deflected slightly upward. From there it passes, for example, to a two-roll pull press, 31, 32 which is only diagrammatically shown in FIG. 1.

In the wet press, the press roll 10 is provided with a drive 33, which is indicated symbolically. In the same way, the one roll of the pull press 31, 32 has a drive 34. In a known manner, the ratio of the speeds of rotation of the two drives 33 and 34 can be sensitively adjusted in order to produce a given tensile stress in the paper web 15.

In FIG. 1, the upper felt belt 16 has a higher water-absorption capacity than the lower felt 17, primarily because the press roll 10 around which the upper felt 16 wraps has the above-mentioned blind holes, circumferential grooves, or the like, for retaining water. The upper felt 16 will be referred to hereinafter at times as the "first belt" or "first felt." The lower felt 17 will be referred to hereinafter at times as the "second belt" or "second felt."

The angle of emergence of the upper felt 16 is designated a in FIG. 1. This angle a can be changed by vertical displacement of the guide roll 19. In the same way the angle of emergence b of the lower felt 17 can be varied by vertical displacement of the guide roll 20. The angles of emergence a and b are defined as the respective angles between the press plane E and the direction of emergence of the first felt 16 and second felt 17, measured on the side of each felt which faces the press roll 10 on the press shoe 11.

Figure 2:
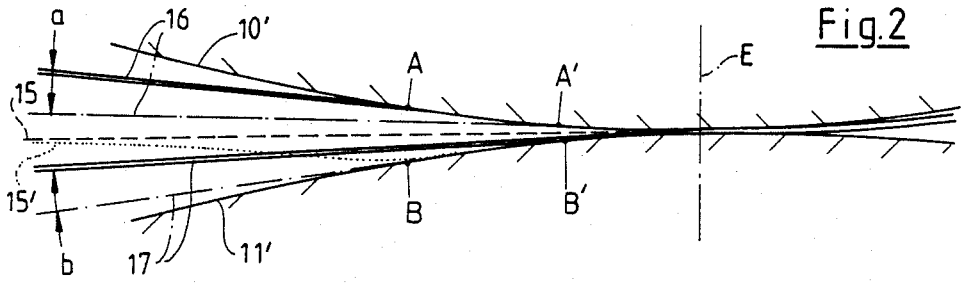
FIG. 2 diagrammatically shows the press nip of a two-roll double-felt press similar to that shown in FIG. 1, on a larger scale.

Referring now to both FIG. 1 and FIG. 2, in order that the paper web 15 be remoistened as little as possible by the two felt belts 16 and 17 in the region of emergence of the wet press, the following procedure is followed. Upon the "threading" of the paper web into the paper machine, i.e., upon the so-called licking-up, the angle a is set to a relatively large value and the angle b to a relatively small value. Thus the two felts 16 and 17, upon leaving the press nip, travel on the travel paths indicated by the dash-dot lines. In this way the paper web 15, upon emergence from the press nip, does not adhere to the wetter upper felt 16; rather it travels for a distance together with the drier lower felt 17. It can be relatively easily detached from the latter by carefully increasing the tensile stress. Then, when the paper web 15 is travelling in a stable manner at the end of the licking-up process, the guide rolls 19 and 20 are then shifted upward so that the angle a is reduced and the angle b increased. The two felts 16 and 17 now emerge from the press nip on the travel paths indicated by solid lines. By this change in the angles a and b, the place of detachment of the paper web from the lower felt is moved even closer to the place of emergence from the press nip. In this way, remoistening is reduced to a minimum.

The process described above will now be explained again in more detail, with reference to FIG. 2. This figure shows two press rolls 10' and 11', which together form a press nip, and once again the paper web 15, the upper belt 16 and the lower felt 17. The travel paths which the two felts 16 and 17 assume in normal continuous operation are shown in solid double lines, while the travel paths during the licking-up process are each shown by a dash-dot line. It can be seen that by increasing the angle of emergence a of the upper felt 16, the point at which the upper felt 16 separates from the press roll 10' is moved from a point A to a point A'. In this way, as already mentioned above, the air wedge which is present between the press roll and the upper felt extends substantially closer to the press nip than before. In this way the paper web 15 is prevented from adhering to the upper felt 1 upon emergence from the press nip.

The reverse process takes place in the case of the lower felt 17. Here, in carrying out the licking-up process, the angle of emergence b is intentionally reduced and the place where the lower felt separates from the press roll 11' is thus shifted from point B to pint B'.

In short, there is a tendency for the paper web 15, upon leaving the press nip, to adhere initially over a certain distance to the lower felt 17 during the licking-up process, and then travel for instance along the dotted line 15' (FIG. 2) to the guide roll 30 (FIG. 1). Then, when the felts 16, 17 again assume their normal (upper) travel paths, the paper web 15 detaches itself at a very short distance behind the press nip from the lower felt 17; in other words, it travels almost completely free of the felts to the guide roll 30.

In FIG. 1 there are also shown the angles d and e. The angles d and e may vary between approximately 2° and 8°. Preferably, the angle d between the paper web 15 and the direction of emergence of the upper felt 16 amounts to about 3° during the licking-up process. Then, by lifting the guide roll 19, the angle d is increased to about 6°. The angle e between the paper web 15 and the direction of discharge of the lower felt 17 is preferably about 6° for the licking-up, and is decreased by raising the guide roll 20 to about 3° for continuous operation.

Figure 3:
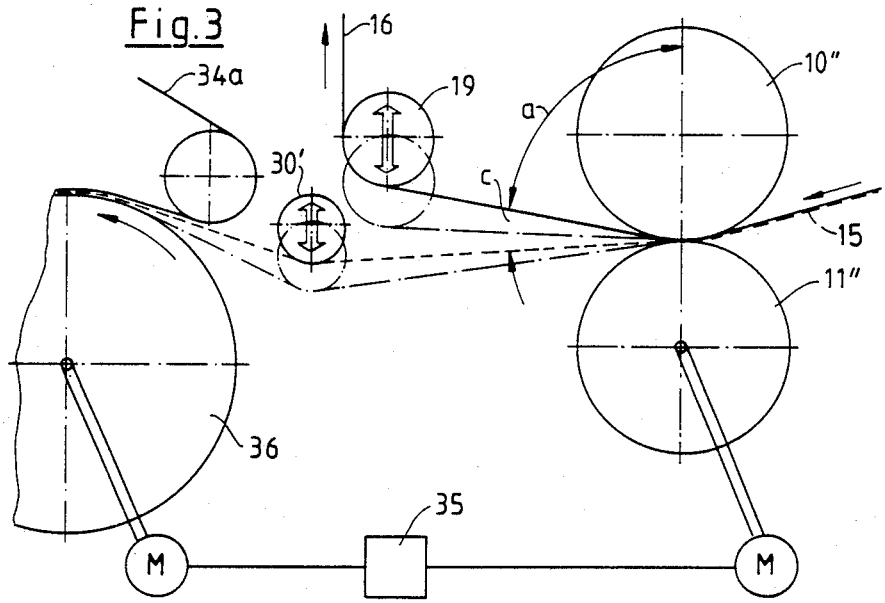
FIG. 3 diagrammatically shows a two-roll single-felt press.

The wet press shown in FIG. 3 has two press rolls 10" and 11". In this case, only a single felt 16 travels through the press nip, together with the paper web 15 from which the water is to be removed, said felt 16 travelling on the emergence side over a vertically displaceable guide roll 19. The paper web 15 travels from the press nip over guide roll 30' to the first cylinder 36 of a dry end of the paper manufacturing machine, where the paper web is conducted by a supporting belt 34*a*.

In accordance with the diagrammatic showing in FIG. 3, electric motors M are provided for the press roll 11" and the drying cylinder 36. These motors are connected by a speed-of-rotation control 35 in order to set a given variable tensile stress in the paper web 15. In FIG. 3 it is diagrammatically indicated that, if necessary, displacement of the paper guide roll 30' in the vertical direction can also be provided. In this way, the angle c between the paper web 15 and the felt belt 16 can remain constant upon a change in the angle of emergence a.

Figure 4:
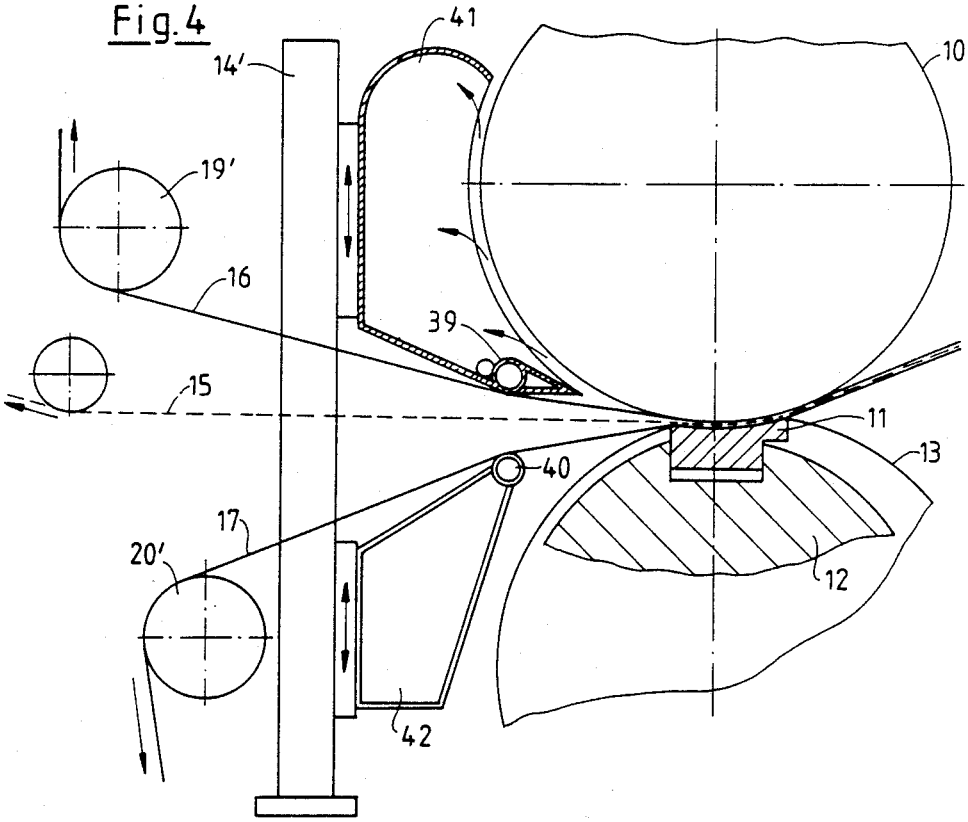
FIG. 4 diagrammatically shows a double-felt long-nip press, according to a modification of FIG. 1.

In FIG. 4, which is a modification of FIG. 1, there are again provided a press roll 10, a press shoe 11, a support member 12 and a press shell 13. The guide rolls 19' and 20' for the two felt belts 16 and 17 are supported rigidly in this case on a stand 14' or may be selectively displaceable generally transverse to the web travel path and/or substantially parallel to the press plane. To vary the angle of emergence of the two felt belts, non-rotating belt guide elements 39 and 40 are provided at the smallest possible distance from the point of emergence from the press nip. The upper belt guide element 39 can be a part of a collection trough 41 for spray water, as shown in FIG. 4. This collection trough extends parallel to the axis along the entire press roll 10 and is supported at its two ends in vertically adjustable manner on the stand 14'. The lower belt guide element 40 is fastened to a support 42 which also extends transversely across the paper machine and is supported for vertical displacement on the stand 14'. The upper felt 16 is deflected a small amount upward by the felt guide element 39 and the lower felt 17 is deflected a small amount downward by the felt guide element 40. The degree of deflection can be changed by vertical displacement of the belt guide elements 40 and 41. Accordingly, the angles of emergence of the two felt belts 16 and 17 are varied in exactly the same way as described above with reference to FIGS. 1 and 2.

An example of an arrangement for the press shoe 11, support member 12, press shell 13, and press roll 10, which may be employed in the embodiment of FIG. 4, is disclosed in U.S. patent application Ser. No. 164,542, filed simultaneously herewith (based on DE-P-No. 37 08 189.6 filed Mar. 13, 1987), commonly assigned herewith, whose disclosures are incorporated by reference herein.

Although an embodiment of the invention has been described in detail herein, it is to be understood that the same is by way of illustration rather than limitation, and that modifications and variations thereof may occur to one of ordinary skill in the art, still within the scope of the invention, as defined in the claims.

What is claimed is:

1. A wet press in a paper machine for dewatering a fiborus web, comprising:

frame means;

first and second press means, each of said press means comprising a press member which is rotatable about an axis of rotation; said press members together forming a press nip; the axis of said first press member defining a press plane wit said press nip;

guide means for guiding a fibrous web to be dewatered and at least a water-absorbing first belt through the press nip, thereby defining a web travel path of said fibrous web:

said guide means including first belt exit guide means for guiding said first belt following its exit from the press nip; so that said first belt defines an angle of emergence (a) with said press plane on the side of said first belt away from said press nip;

said first belt exit guide means having adjusting means for adjusting said angle of emergence (a) to a first value during a first phase of dewatering said fibrous web in said wet press, and to a second valve during a second phase of dewatering said fibrous web in said wet press;

wherein said guide means further includes web exit guide means for guiding said fibrous web from the press nip, in an open draw substantially free of said first and second press members and of said first belt, after emergence from said press nip; and means controlling the tensile stress on said fibrous web as it is guided from said press nip during both said phases;

wherein said first belt exit guide means comprises a first belt exit guide roll which is mounted for being selectively displaceable generally transverse to said web travel path by said adjusting means; and a non-rotating deflection member which is mounted for being displacable substantially parallel to said press plane by said adjusting means.

2. A wet press as in claim 1, wherein said guide means is operable for adjusting said angle of emergence a to said first value when said fibrous web is being threaded into said paper machine, and to said second value at a subsequent time, said second value being smaller than said first value.

3. S wet press as in claim 1, wherein said deflection member is attached to a spray water collection trough.

4. A wet press as in claim 1, wherein said first belt exit guide roll is mounted for being displaceable substantially parallel to said press plane by said adjusting means.

5. A wet press as in claim 1, wherein said first belt comprises felt material.

6. A wet press as in claim 1, wherein said first belt is endless and forms a loop which encloses said first press member.

7. A wet press as in claim 1, wherein said first belt exit guide means and web exit guide means are structured to maintain a substantially constant angle (c) between said first belt and said web.

8. A wet press as in claim 4, wherein said web exit guide means includes a web exit guide roll which is mounted for being selectively displaceable generally transverse to said web travel path by web exit guide roll adjusting means.

9. A wet press as in claim 8, wherein said web exit guide roll is mounted for being displaceable substantially parallel to said press plane by said web exit guide roll adjusting means.

10. A wet press in a paper machine for dewatering a fibrous web, comprising:

frame means;

first and second press means, each of said press means comprising a press member which is rotatable about an axis of rotation; said press members together forming a press nip; the axis of said first press member defining a press plane with said press nip;

guide means for guiding, through the press nip, a fibrous web to be dewatered, and at least a first belt and a second belt which enclose said web, thereby defining a web travel path of said fibrous web;

said guide means including first and second belt exit guide means for respectively guiding said first and second belts following their exit from the press nip; so that said first belt defines an angle of emergence (a) with said press plane on the side of said first belt away from said press nip; and said second belt defines an angle of emergence (b) with said press plane on the side of said second belt away from said press nip;

said first and second belt exit guide means having adjusting means for adjusting said angles of emergence (a) and (b) to respective first values during a first phase of dewatering said web, and to respective second values during a second phase of dewatering said web;

wherein said guide means further includes web exit guide means for guiding said fibrous web from the press nip, in an open drawn substantially free of said first and second press members and of said first and second belts, after emergence from said press nip; and means controlling the tensile stress on said fibrous web as it is guided from said press nip during both said phases;

wherein said first and second belt exit guide comprise respective non-rotating deflection members which are mounted for being selectively displacable generally transverse to said web travel path by said adjusting means.

11. A wet press as in claim 10, wherein said guide means is structured and arranged for adjusting said angles of emergence a and b to their first values when said web is being threaded into said paper machine; and to said second values at a subsequent time.

12. A wet press as in claim 10, wherein said first belt is water-absorbent and forms and endless loop which encloses said first press member.

13. A wet press as in claim 12, wherein said second belt forms an endless loop which encloses said second press member.

14. A wet press as in claim 13, wherein said first belt comprises felt material.

15. A wet press as in claim 14, wherein said second belt has lower water-absorbency than said first belt.

16. A wet press as in claim 15, wherein said second belt comprises felt material.

17. A wet press as in claim 15, wherein said second belt is substantially liquid-impervious.

18. A wet press as in claim 10, wherein said first and second belt exit guide means are structured and arranged for adjusting said second value of angle a to be smaller than said first value; and said second value of angle b to be larger than said first value.

19. A wet press as in claim 18, wherein said first and second belt exit guide means are structured and arranged for adjusting said angles a and b such that their sum remains substantially constant during said two phases.

20. A wet press as in claim 10, wherein said first and second belt exit guide means are mounted for being displacable substantially parallel to said press plane by said adjusting means.

21. A wet press as in claim 10, wherein said first and second belt exit guide means comprise respective guide rolls.

22. A wet press as in claim 10, wherein said first belt exit guide means is attached to a spray water collection trough.

23. A wet press as in claim 10, wherein said first and second belts respectively define angles d and e with said web travel path, said angles d and e being substantially 2°–8°.

24. A wet press as in claim 23, wherein said angle d increases from about 3° to about 6° from said first phase to said second phase.

25. A wet press as in claim 24, wherein said angle e decreases from about 6° to about 3° from said first phase to said second phase.

26. A wet press as in claim 10, further comprising press shoe means within said second press member for urging said second belt toward said first press member.

27. A wet press as in claim 26, wherein said second press member comprises a press shell which rotates around a support member, said press shoe means comprising a press shoe mounted on said support member for urging said press shell against said second belt and toward said first press member.

28. A wet press as in claim 27, wherein the axis of rotation of said press shell is substantially at said press plane.

29. A wet press as in claim 27, wherein the axis of rotation of said press shell is offset from said press plane in a direction away from said belt exit guide means; whereby said press shell is eccentric to said press plane.

30. A wet press as in claim 29, wherein said press shoe has a slide surface which contacts an inside surface of said press roll and defines a width of an areal press nip, the center of said slide surface being spaced from the press plane in a direction away from said belt exit guide means.

31. A wet press as in claim 30, wherein said slide surface of said press shoe has an extension on a side of said press shoe opposite said exit belt exit quite means, the center of the slide surface of the press shoe being thereby offset from the press plane so that the extension is located substantially within the eccentric press shell.

32. A roll press as in claim 31, wherein said press shell is substantially circular.

33. A method of operating a wet press in a paper machine for dewatering a fibrous web, said wet press comprising:

first and second press elements together forming a press nip, an axis of rotation of said first press element defining a press plane with said press nip; said method comprising the steps of:

guiding at least a first water-absorbent belt, together with said web, through said press nip;

adjusting an angle (a) defined between said first belt and said press plane to a first value during a first phase of dewatering said web, and to a second value during a second phase of dewatering said web;

guiding said fibrous web from the press nip, in an open draw substantially free of said first and second press elements and of said first belt, after emergence from said press nip; and controlling the tensile stress on the fibrous web as it is guided from the press nip during both said phases;

wherein said angle (a) has said first value when said web is being threaded into said paper machine, and said second value at a subsequent time, said second value being smaller than said first value; and further comprising guiding a second belt through said press nip together with said first belt and said web; said first and second belts sandwiching said web; and adjusting an angle (b) defining between said second belt and said press plane to a first value when said web is being initially inserted into said press, and a second value at a subsequent time, said second value being larger than said first value.

34. A method as in claim 33, further comprising maintaining a substantially constant angle c between said first belt and said web during said two phases.

35. A method as in claim 33, wherein said angles a and b are adjusted such that their sum remains substantially constant during said two phases.

36. A method as in claim 33, wherein said first and second belts respectively define angles d and e with said web, said angles d and e being substantially 2°–8°.

37. A method as in claim 36, wherein said first angle d increases from about 3° to about 6° from said first phase to said second phase.

38. A method as in claim 37, wherein said angle e decreases from about 6° to about 3° from said first phase to said second phase.

* * * * *